US009291048B2

(12) United States Patent
MacPhail et al.

(10) Patent No.: US 9,291,048 B2
(45) **Date of Patent: *Mar. 22, 2016**

(54) SYSTEM AND METHOD FOR TRIGGERING A DOWNHOLE TOOL

(71) Applicant: Halliburton Energy Services, Inc., Houston, TX (US)

(72) Inventors: Charles M. MacPhail, Little Elm, TX (US); Paul Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/804,365

(22) Filed: Jul. 21, 2015

(65) Prior Publication Data

US 2015/0322777 A1 Nov. 12, 2015

Related U.S. Application Data

(63) Continuation of application No. 13/888,690, filed on May 7, 2013, now Pat. No. 9,121,267, which is a continuation of application No. 13/849,087, filed on Mar. 22, 2013, now Pat. No. 8,701,761.

(51) Int. Cl.

| | |
|---|---|
| ***E21B 33/072*** | (2006.01) |
| ***E21B 47/12*** | (2012.01) |
| ***E21B 47/14*** | (2006.01) |

(Continued)

(52) U.S. Cl.

CPC ..... *E21B 47/12* (2013.01); *E21B 23/00* (2013.01); *E21B 33/072* (2013.01); *E21B 41/00* (2013.01); *E21B 47/122* (2013.01); *E21B 47/14* (2013.01)

(58) Field of Classification Search

CPC ..... E21B 47/14; E21B 23/00

See application file for complete search history.

(56) References Cited

U.S. PATENT DOCUMENTS

| | | | |
|---|---|---|---|
| 4,921,048 | A | 5/1990 | Crow et al. |
| 9,121,267 | B2 | 9/2015 | MacPhail et al. |

(Continued)

FOREIGN PATENT DOCUMENTS

| | | | |
|---|---|---|---|
| WO | 2009002181 | A1 | 12/2008 |
| WO | 2009154501 | A1 | 12/2009 |

OTHER PUBLICATIONS

Official Action for Australian Patent Application No. 2012378293 dated Jul. 31, 2015.

(Continued)

*Primary Examiner* — David Andrews

(74) *Attorney, Agent, or Firm* — McDermott Will & Emery LLP; John W. Wustenberg

(57) ABSTRACT

A method of servicing a wellbore includes arranging an assembly within a lubricator coupled to a tree, the assembly including at least one downhole tool and a signal receiver subassembly. An acoustic signal is communicated to the signal receiver subassembly while the assembly is arranged within the lubricator. The acoustic signal is perceived with a transceiver communicably coupled to the signal receiver subassembly and thereby activates a timer communicably coupled to the signal receiver subassembly while the assembly is arranged within the lubricator. The assembly is introduced into the wellbore and advanced until reaching a target depth. A trigger signal is them transmitted with the signal receiver subassembly to the at least one downhole tool to actuate the at least one downhole tool.

19 Claims, 3 Drawing Sheets

(51) Int. Cl.
*E21B 23/00* (2006.01)
*E21B 41/00* (2006.01)

(56) References Cited

U.S. PATENT DOCUMENTS

2003/0117134 A1 6/2003 Almaguer
2005/0241824 A1 11/2005 Burris et al.
2005/0269083 A1* 12/2005 Burris ..... E21B 23/00 166/255.2
2006/0124318 A1* 6/2006 Sheffield ..... E21B 17/023 166/381
2009/0115624 A1 5/2009 Tinnen et al.
2011/0079386 A1* 4/2011 Fripp ..... E21B 41/00 166/249

OTHER PUBLICATIONS

Official Action for Singapore Patent Application No. 11201405996X dated Oct. 14, 2015.

* cited by examiner

SYSTEM AND METHOD FOR TRIGGERING A DOWNHOLE TOOL

CROSS-REFERENCE TO RELATED APPLICATIONS

The present application is a continuation of U.S. patent application Ser. No. 13/888,690 filed on May 7, 2013, which is a continuation of U.S. Pat. No. 8,701,761 filed on Mar. 22, 2013, which claims priority to International Patent App. No. PCT/US2012/034901, which was filed on Apr. 25, 2012.

BACKGROUND

The present invention relates to wellbore servicing systems and methods, and in particular, to systems and methods for remotely activating a downhole tool.

Hydrocarbons are typically produced from wellbores drilled from the surface through a variety of producing and non-producing subterranean zones. The wellbore may be drilled substantially vertically or may be drilled as an offset well that has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may extend substantially horizontal toward the surface. In some production sites, wellbores may be very deep, for example extending more than 10,000 feet from the surface.

A variety of servicing operations may be performed in a wellbore after it has been drilled and completed. One common servicing operation is fluid sampling, which may be undertaken to obtain a fluid sample of the subterranean formation in order to determine the composition, temperature, and pressure of the formation fluids of interest. In a typical sampling procedure, the sample is obtained by lowering a sampling tool into the wellbore on a conveyance, such as a wireline, slickline, coiled tubing, jointed tubing or the like. When the sampling tool reaches the desired depth, the sampling tool is triggered and one or more ports are opened to allow collection of the formation fluids. The ports may be actuated in a variety of ways such as by electrical, hydraulic or mechanical methods. After the sample has been collected, the sampling tool is withdrawn from the wellbore so that the fluid sample may be analyzed at the surface.

Slickline sampling tools are commonly triggered using a timing mechanism that is programmed by an operator at the surface. The operator generally programs the timing mechanism with a generous time window that will allow the sampling tool to reach the predetermined location in the wellbore before being triggered. In programming the timing mechanism, the operator must factor in sufficient prep time, such as, the time that it takes to make up the downhole equipment, the time required to properly pressure test the well, the time required to convey the sampler to the predetermined depth, and the time required to condition the sample flow to suitable conditions, if necessary. Since the time to complete these routine operations is oftentimes an unknown and varies from job to job, the general rule is to program the timing mechanism with a large enough window that compensates for overly long prep time. However, in cases where prep operations are completed without any setback or delays, the slickline tool can sit at the bottom of the well for hours until the timer finally triggers the sampler as programmed. The time waiting for the timer to trigger equates to several hours of lost rig time which, in turn, equates to substantial losses in operator profits.

SUMMARY OF THE INVENTION

The present invention relates to wellbore servicing systems and methods, and in particular, to systems and methods for remotely activating a downhole tool.

In some aspects of the disclosure, a method of servicing a wellbore is disclosed. The method may include arranging an assembly within a lubricator coupled to a tree, the assembly including at least one downhole tool and a signal receiver subassembly, communicating a signal to the signal receiver subassembly while the assembly is arranged within the lubricator, the signal being configured to activate a timer communicably coupled to the signal receiver subassembly, introducing the assembly into the wellbore and advancing the assembly until reaching a target depth, and transmitting a trigger signal with the signal receiver subassembly to the at least one downhole tool and thereby actuating the at least one downhole tool.

In other aspects of the disclosure, a method of triggering a downhole tool is disclosed. The method may include programming a timer with a finite time period corresponding to a time required for an assembly to reach a target depth within a wellbore, the assembly including a signal receiver subassembly and at least one downhole tool, wherein the timer is communicably coupled to the signal receiver subassembly, arranging the assembly within a lubricator and activating the timer, recognizing with the signal receiver subassembly an expiration of the finite time period, and actuating the at least one downhole tool in response to the expiration of the finite time period.

In yet other aspects of the disclosure, an assembly is disclosed and may include at least one downhole tool, a signal receiver subassembly communicably coupled to the at least one downhole tool, a timer communicably coupled to the signal receiver subassembly, the timer being preprogrammed with a finite time period corresponding to a time required for the assembly to reach a target depth, and a transceiver communicably coupled to the signal receiver subassembly and configured to receive a signal that activates the timer.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to wellbore servicing systems and methods, and in particular, to systems and methods for remotely activating a downhole tool, such as a sampling unit, and thereby saving valuable rig time. Embodiments disclosed include a signal receiver subassembly having a timer communicably coupled thereto and configured to trigger or otherwise actuate the downhole tool at a time pre-programmed into the timer. The timer may be advantageously activated at the surface after the downhole tool has been properly assembled and the appropriate pressure testing and other surface preparation procedures have been completed. Consequently, the operator is not required to add additional time to the timer in order to compensate for routine prep time, but is instead able to activate the timer just before sending the downhole tool into the wellbore. Since the travel time to the predetermined location where the downhole tool is to be triggered is generally known, the operator may program the timer only for downhole travel time such that the downhole tool is triggered a short time after reaching the predetermined location. Such an improvement is clearly advantageous over current systems which oftentimes result in the downhole tool idly sitting at the predetermined location for long periods of time before the timer triggers the downhole tool. As can be appreciated, this may greatly reduce rig time, and therefore reduce operator costs.

Figure 1:
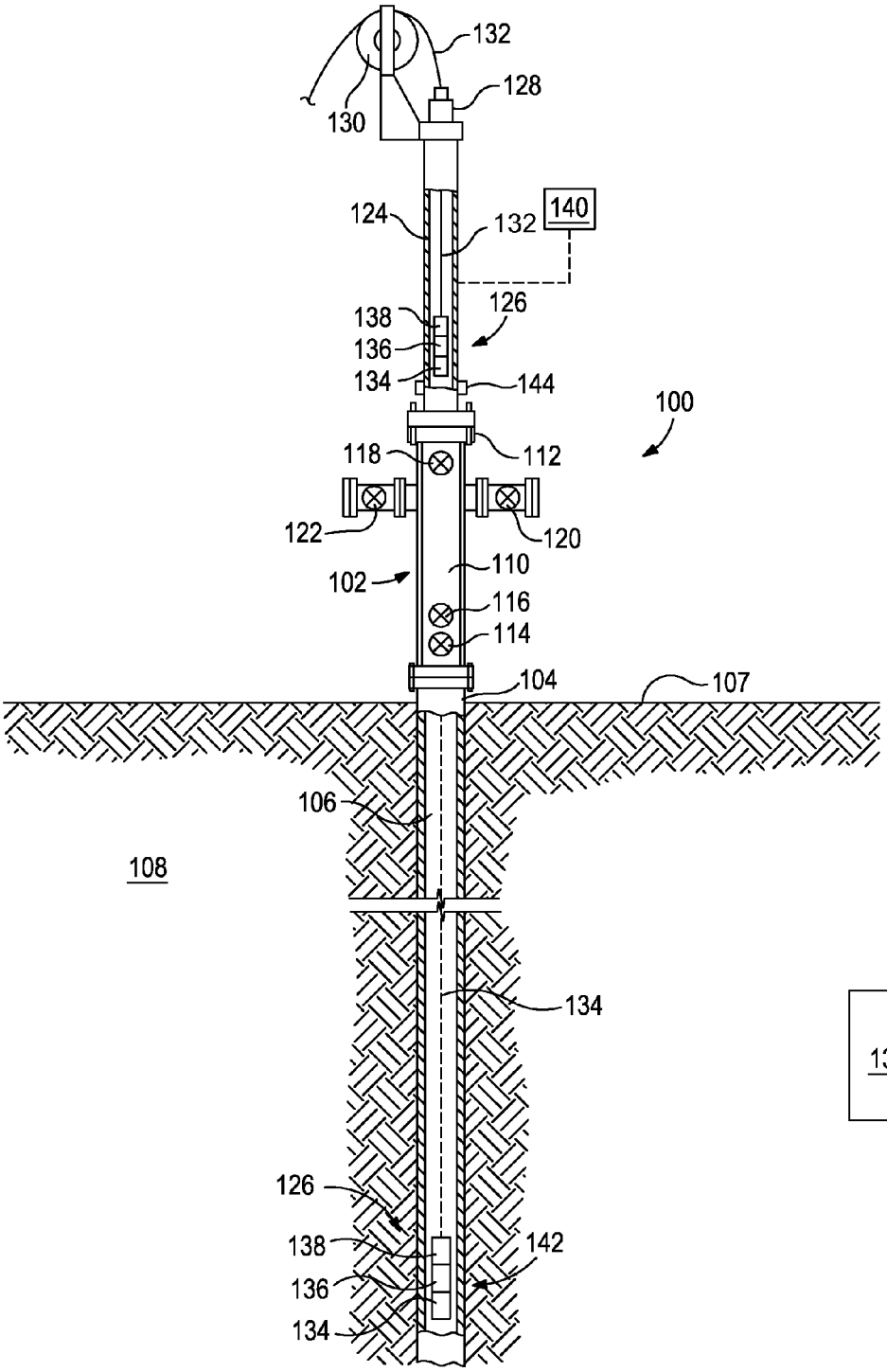
FIG. 1 illustrates a wellbore system having an assembly, according to one or more embodiments disclosed.

Referring to FIG. 1, illustrated is an exemplary wellbore system 100, according to one or more embodiments. The system 100 may include a Christmas tree 102 (hereinafter "tree") operatively coupled to a wellhead 104 installed on an adjacent wellbore 106. The tree 102 may be coupled to the wellhead 104 using a variety of known techniques, e.g., a clamped or bolted connection. Moreover, additional components (not shown), such as a tubing head and/or adapter, may be positioned between the tree 102 and the wellhead 104. The tree 102 may be of any known type, e.g., horizontal or vertical, or may alternatively be any structure or body that comprises a plurality of valves used to control hydrocarbon production from a subterranean formation. Those skilled in the art will readily recognize that the illustrative arrangement of the tree 102 and the wellhead 104 should not be considered a limitation of the present invention, but instead many variations of the arrangement may be had without departing from the scope of the disclosure. Moreover, the components or portions of the system 100 extending above the wellbore 106 at the surface 107 may be referred to herein generally as "wellhead surface components."

As illustrated, the wellbore 106 penetrates a subterranean formation 108 for the purpose of recovering hydrocarbons therefrom. While shown as extending vertically from the surface 107 in FIG. 1, it will be appreciated that the wellbore 106 may equally be deviated, horizontal, and/or curved over at least some portions of the wellbore 106, without departing from the scope of the disclosure. The wellbore 106 may be cased, open hole, contain tubing, and/or may generally be characterized as a hole in the ground having a variety of shapes and/or geometries as are known to those of skill in the art. Furthermore, it will be appreciated that embodiments disclosed herein may be employed in surface or subsea wells.

In general, the tree 102 includes a body 110, an adapter 112 and a plurality of valves, such as a lower master valve 114, an upper master valve 116, a swab valve 118, a production wing valve 120, and a kill wing valve 122. It will be appreciated that the exact arrangement or number of the valves 114-122 may vary depending upon the particular application. The system 100 may further include a lubricator 124 coupled or otherwise attached to the tree 102 at the adapter 112. The lubricator 124 may be an elongate, high-pressure pipe or tubular fitted to the top of the tree 102 and configured to provide a means for introducing an assembly 126 into the wellbore 106 through the tree 102 in order to undertake a variety of servicing operations within the wellbore 106. The top of the lubricator 124 may include a high-pressure grease-injection section and sealing elements 128. In one or more embodiments, a block 130 may be coupled to the lubricator 124 and may be configured to provide a conveyance 132 for conveying the assembly 126 into the wellbore 106. In some embodiments, the conveyance 132 may be a slickline unit. In other embodiments, however, the conveyance 132 may be, but is not limited to, any of a sandline, a coiled tubing, a wireline, or any other mechanical connection means known in the art.

Once properly installed on the tree 102, the lubricator 124 may be pressure tested and the assembly 126 placed therein, at which point the lubricator 124 may be pressurized to at or above wellbore 106 pressure. Once the lubricator 124 is properly pressurized, one or more of the valves on the tree 102, such as the swab valve 118, is opened to enable the assembly 126 to be introduced into the wellbore 106 via the tree 102. In some embodiments, the assembly 126 simply falls into the wellbore 106 using gravitational forces. In other embodiments, however, the assembly 126 may be pumped into the wellbore 106 under pressure. To remove the assembly 126 from the wellbore 106, the conveyance 132 is retracted and the reverse of the process described above is generally followed.

In one or more embodiments, the assembly 126 may include at least one downhole tool 134 and a signal receiver subassembly 136. In some embodiments, the assembly 126 may further include a second downhole tool 138. The downhole tools 134, 138 may be any one of a sampler, a completion tool, a drilling tool, a stimulation tool, an evaluation tool, a safety tool, an abandonment tool, a packer, a bridge plug, a setting tool, a perforation gun, a casing cutter, a flow control device, a sensing instrument, a data collection device and/or instrument, a measure while drilling (MWD) tool, a log while drilling (LWD) tool, a drill bit, a reamer, a stimulation tool, a fracturing tool, a production tool, combinations thereof, and the like.

The signal receiver subassembly 136, in combination with other components depicted in FIG. 1, may provide an efficient, reliable, and user-friendly communication interface and tool between an operator or user of the system 100 and the downhole tools 134, 138. In an embodiment, the signal receiver subassembly 136 may be incorporated into and/or integrated with one or both of the downhole tools 134, 138. For example, in an embodiment, the signal receiver subassembly 136 and the first downhole tool 134 (or second downhole tool 138) may share one or more of a housing, a power supply, a memory, a processor, and/or other components.

The downhole tools 134, 138 may include and/or be coupled to any of a variety of actuating devices and/or contrivances (not shown) configured to actuate the downhole tools 134, 138. In some embodiments, the signal receiver subassembly 136 may be communicably coupled (e.g., wired or wirelessly) to the actuating device(s) and configured to transmit a trigger signal thereto in order to trigger the actuation of the one or more downhole tools 134, 138. In some embodiments, the actuating device(s) may be considered part of the downhole tools 134, 138. In other embodiments, however, the actuating device(s) may be separate from the downhole tools 134, 138 and may instead be characterized as a separate component of the assembly 126. Suitable actuating devices are described in U.S. patent application Ser. No. 12/768,927 filed Apr. 28, 2010 and entitled "Downhole Actuator Apparatus Having a Chemically Activated Trigger," U.S. patent application Ser. No. 12/688,058 filed Jan. 15, 2010 and entitled "Well Tools Operable via Thermal Expansion Resulting from Reactive Materials," and U.S. patent application Ser. No. 12/353,664 filed Jan. 14, 2009 and entitled "Well Tools Incorporating Valves Operable by Low Electrical Power Input." The contents of each of these references are hereby incorporated by reference for all purposes.

Figure 2:
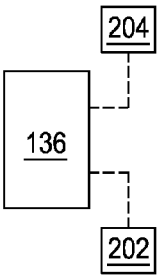
FIG. 2 illustrates an exemplary signal receiver subassembly as used in the assembly shown in FIG. 1, according to one or more embodiments.

Referring briefly to FIG. 2, with continued reference to FIG. 1, illustrated is an exemplary schematic of the signal receiver subassembly 136, according to one or more embodiments. In some embodiments, the signal receiver subassembly 136 may include or is otherwise communicably coupled to a programmable timer 202 and a transceiver 204. In at least one embodiment, the timer 202 may be an electronic clock that is programmable by an operator of the system 100 at the surface. In operation, the timer 202 may be programmed with a finite time period and subsequently activated by the signal receiver subassembly 136, thereby resulting in a timed countdown that terminates when the finite time period expires. The signal receiver subassembly 136 may be configured to recognize the expiration of the finite time period and, as a consequence thereof, convey the trigger signal to the one or more actuating device(s) which results in the actuation of the one or more downhole tools 134, 138.

The transceiver 204 may be configured to receive and transmit electronic or acoustic signals via, for example, electromagnetic or acoustic telemetry methods. In other embodiments, however, the transceiver 204 may be configured to receive and transmit signals via radio frequency signals or the like. According to some embodiments, an electronic or acoustic signal may be received by the signal receiver subassembly 136 via the transceiver 204 in order to activate the timer 202 and thereby initiate the timed countdown indicating when the one or more downhole tools 134, 138 are configured to be triggered.

In some embodiments, the electronic/acoustic signal may be received by the transceiver 204 while the assembly 126 is arranged within the lubricator 124. In other embodiments, the electronic/acoustic signal may be received by the transceiver 204 while the assembly 126 is arranged within any portion of the wellhead surface components (i.e., within the tree 102). Moreover, the electronic/acoustic signal may be received by the transceiver 204 after the wellbore 106 and lubricator 124 have been properly pressure tested and after the assembly 126 is appropriately installed within the lubricator 124 and ready to be dropped into the wellbore 106 or already descending thereto. Consequently, in one or more embodiments, the finite time period entered into the timer 202 may only need to reflect the time required for the assembly 126 to reach the target site within the wellbore 106 where the downhole tools 134, 138 are to be triggered.

Referring again to FIG. 1, with continued reference to FIG. 2, in some embodiments a signal, such as an acoustic signal, may be provided by the operator and received by the transceiver 204 while the assembly 126 is arranged within the lubricator 124. In at least one embodiment, the operator may tap or otherwise strike the tree 102, or other wellhead surface components (e.g., the lubricator 124), and thereby generate a signal in the form of an acoustic vibration or frequency that is recognizable or at least receivable by the transceiver 204. In one embodiment, the operator may strike or tap the swab valve 118, for example, in order to transmit the signal to the transceiver 204. It will be appreciated, however, that the acoustic signal may be generated in a variety of ways, without departing from the scope of the disclosure. For instance, in some embodiments, a transducer (not shown) may be coupled to the tree 102, the lubricator 124, or any other wellhead surface component, and configured to generate a vibration at a particular frequency that may be recognizable by the transceiver 204.

The signal receiver subassembly 136 may be configured to receive the generated acoustic frequency or vibration (i.e., via the transceiver 204) and process this value in order to determine if the signal matches a predetermined frequency or vibration threshold required to activate the timer 202. For example, in an embodiment, the signal receiver subassembly 136 may be designed and/or programmed to identify a particular frequency that the operator, a transducer, or any other frequency or vibration generating device may generate. In some embodiments, the signal receiver subassembly 136 may perform frequency selective filtering to exclude and/or attenuate frequencies outside the main frequency bandwidth of the generated signal frequency and pass the frequencies falling within the main frequency bandwidth. This may contribute to fewer spurious signals being interpreted by the signal receiver subassembly 136 as valid communications stemming from the operator or otherwise.

Decoding the signal communicated to the signal receiver subassembly 136 at the surface 107 may involve one or more of a variety of signal processing and/or signal conditioning operations. For example, decoding may include, but is not limited to, sensing and/or transducing a physical quality or phenomenon of the generated frequency or vibration into an electrical signal, analog to digital conversion of the resulting electrical signal, and optionally frequency filtering the electrical signal to remove spurious signals. Decoding may further include determining a discrete number in the calculated electrical signal and comparing the discrete number to one or more stored numbers within the signal receiver subassembly 136 which, in some contexts, may be referred to as a trigger number, to determine that activation of the timer 202 has been commanded by the operator or otherwise.

In an embodiment, the signal communicated to the signal receiver subassembly 136 may be framed within distinct time intervals recognized by the signal receiver subassembly 136. For instance, the signal may be composed of an ordered sequence of vibrations, where each vibration is communicated within a specific time interval. For example, and not by way of limitation, the signal may be communicated to the transceiver 204 via a series of distinct taps (e.g., 3 taps, 5 taps, 7 taps, etc.) within a specific time interval (e.g., 5 seconds, 10 seconds, 15 seconds, 20 seconds, etc.) made on the physical components of the system 100, such as any of the wellhead surface components. The signal receiver subassembly 136 or another component of the assembly 126 may receive and convert the generated mechanical vibration or acoustic signal into an electrical signal that serves to activate the timer 202.

In one or more embodiments, the signal receiver subassembly 136 may further be configured to send an acoustic/electronic signal via the transceiver 204, or other integral component of the signal receiver subassembly 136, to be received by the operator in order to instantaneously confirm that the timer 202 has been activated. In at least one embodiment, a listening device 140 may be communicably coupled to the lubricator 124, the tree 102, or any other wellhead surface component, and configured to perceive some sort of an acoustic or electronic signal emanating from the signal receiver subassembly 136 and report the same to the operator. In some embodiments, the listening device 140 may be a commercially-available microphone or amplifier communicably coupled via a wired or a wireless link to an adjacent computer (not shown) or mobile handset at the location of the system 100, such that the operator is immediately informed of the status of the timer 202 (e.g., whether activated, idle, or disabled). Consequently, the operator is then informed of how much time remains until the one or more downhole tools 134, 138 are programmed to be actuated.

Still referring to FIG. 1, once the timer 202 is properly activated, the assembly 126 may be dropped into the wellbore 106. To drop the assembly 126 into the wellbore 106, at least the swab valve 118 is opened and the lubricator 124 is thereby pressurized to the pressure of the wellbore 106. The assembly 126 may then be introduced into the wellbore 106 until reaching a target depth 142 where the one or more downhole tools 134, 138 are configured to be actuated. Since the target depth 142 and the speed of the conveyance 132 would be generally known by the operator, the time required to reach the target depth 142 may also be readily determined. Accordingly, the operator may be able to program the timer 202 with sufficient time (e.g., the "finite time period") for the assembly 126 to reach the target depth 142 before proper actuation of the one or more downhole tools 134, 138.

The functions of the downhole tools 134, 138 that the signal receiver subassembly 136 may actuate may include any of initiating detonation of a perforation gun, opening or closing one or more valves or ports (i.e., in a sampling unit), opening or closing a sliding sleeve, causing a setting tool to set and/or release, starting collection of data, stopping collection of data, starting transmission of data, stopping transmission of data, activating and/or deactivating an electronic device, broaching a fluid bulkhead, breaking a rupture disk, and others. The downhole tools 134, 138 may promote a variety of wellbore services including, but not by way of limitation, retrieving wellbore fluid samples, hanging a liner, cementing, stimulation, hydraulic fracturing, acidizing, gravel packing, setting tools, setting lateral junctions, perforating casing and/or formations, collecting data, transmitting data, drilling, reaming, and other services.

In some embodiments, the timer 202 may be activated using magnetic forces as the assembly 126 is dropped into the wellbore 106. For example, in at least one embodiment, a portion of the lubricator 124, such as near the bottom thereof, may be made of a non-magnetic material. In one embodiment, the non-magnetic material may be INCONEL® 718, but in other embodiments the non-magnetic material may be any non-magnetic material known to those skilled in the art, such as, but not limited to, copper, silver, aluminum, lead, magnesium, platinum, tungsten, combinations thereof, or the like. One or more magnets 144 may be arranged or otherwise disposed about the non-magnetic portion of the lubricator 124. The magnets 144 may be permanent magnets, such as rare earth magnets, but may also be electromagnets that are manually or programmably actuated. It will be appreciated that in other embodiments the magnets 144 could be placed about any portion of the surface wellbore components, for example about the tree 102, without departing from the scope of the disclosure.

As the assembly 126 is dropped downhole and passes by the magnets 144, magnetic forces emanating from the magnets 144 may be configured to activate the timer 202 and thereby initiate the timed countdown indicating when the one or more downhole tools 134, 138 are configured to be triggered. In at least one embodiment, the magnets 144 may be configured to magnetically remove a pin or other mechanical device from the timer 202 such that the timer 202 is then able to initiate the timed countdown. In other embodiments, the transceiver 204 may be configured to sense or otherwise react to magnetic forces provided by the magnets 144, and thereby initiate the timed countdown. As will be appreciated, the magnets 144 make activating the timer 202 a more passive process, whereas in other embodiments the operator may be required to act. Moreover, this embodiment may prove especially advantageous in applications requiring elevated temperatures that could cause the transceiver 204 or other electronic components to malfunction.

In other embodiments, the timer 202 may be activated using fluid pressure or a predetermined pressure scenario within the lubricator 124. For example, the transceiver 204 may serve as a pressure transducer configured to sense and measure ambient pressures within the lubricator 124. Once pressure testing of the lubricator 124 is completed, the timer 202 may be activated via a variety of ways. For example, the pressure within the lubricator 124 may be bled off (i.e., partially released) to a predetermined pressure and held at that predetermined pressure for a predetermined period of time. The transceiver 204 may be programmed to sense the predetermined pressure and recognize the predetermined period of time, and as a result the transceiver 204 may be configured to signal activation of the timer and thereby initiate the timed countdown.

In other embodiments, the transceiver 204 may be programmed to sense a predetermined pressure scenario or process undertaken within the lubricator 124. The predetermined pressure scenario may include a predetermined sequence of pressure and release or partial releases configured to be sensed and recognized by the preprogrammed transceiver 204 which then activates the timer 202. For example, after pressure testing the lubricator 124, a third of the pressure within the lubricator 124 may be bled off and held for a first predetermined period of time (e.g., two minutes). After the expiration of the first predetermined period of time, another third of the original pressure within the lubricator 124 may be bled off and held for a second predetermined period of time (e.g., two minutes). After the expiration of the second predetermined period of time, the remaining third of the original pressure within the lubricator 124 may be bled off. The transceiver 204 may be programmed or otherwise configured to sense and recognize this predetermined pressure scenario and as a result signal the timer 202 to activate and initiate the timed countdown. It will be appreciated, however, that several variations of the predetermined pressure scenario may be implemented without departing from the scope of the disclosure.

Figure 3:
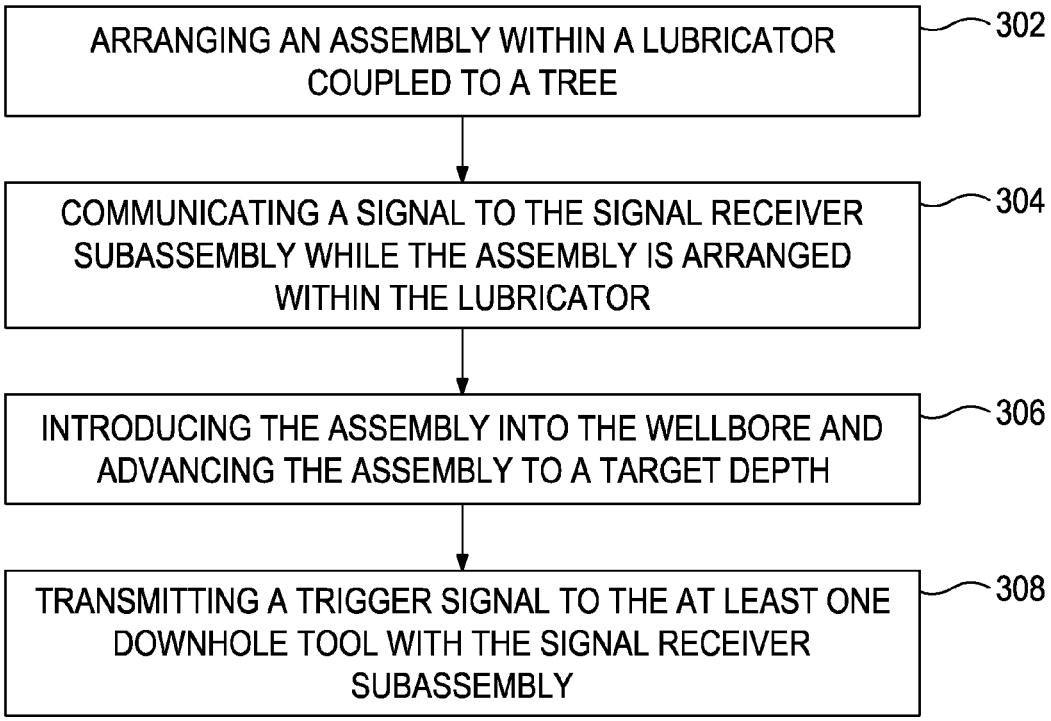
FIG. 3 illustrates a flowchart schematic of a method for servicing a wellbore, according to one or more embodiments disclosed.

Referring now to FIG. 3, illustrated is an exemplary method 300 for servicing a wellbore, according to one or more embodiments. The method 300 may include arranging an assembly within a lubricator coupled to a tree, as at 302. The assembly may include at least one downhole tool, such as any one of the downhole tools 134, 138 described herein, and a signal receiver subassembly, such as the signal receiver subassembly 136 described above. In at least one embodiment, the at least one downhole tool is a sampling unit. Arranging the assembly in the lubricator 124 may include the steps of assembling, making up, and/or building the assembly from its several components, for example coupling the at least one downhole tool and the signal receiver subassembly together and placing them on a conveyance, such as the conveyance 132 described above. In an embodiment, the conveyance 132 may include slickline, wireline, or coiled tubing.

The method 300 may also include communicating a signal to the signal receiver subassembly while the assembly is arranged within the lubricator, as at 304. The communicated signal may be configured to activate a timer that is communicably coupled to or otherwise forming an integral part of the signal receiver subassembly. In some embodiments, communicating the signal to the signal receiver subassembly includes communicating an acoustic signal to the signal receiver subassembly. For example, the acoustic signal may be generated by striking the lubricator, the tree, or other wellhead surface components, or vibrations may be generated using a transducer coupled to some portion of the wellhead surface components. The acoustic signal may be perceived with a transceiver communicably coupled to or otherwise forming an integral part of the signal receiver subassembly. In other embodiments, communicating the signal to the signal receiver subassembly includes communicating an electronic signal to the signal receiver subassembly.

The method 300 may further include introducing the assembly into the wellbore and advancing the assembly until reaching a target depth, as at 306. A trigger signal may then be transmitted to the at least one downhole tool with the signal receiver subassembly, as at 308. The trigger signal may be configured to actuate the at least one downhole tool. In some embodiments, the timer is preprogrammed with a finite time period corresponding to a time required for the assembly to reach the target depth from the wellhead 104 (FIG. 1). Moreover, the signal receiver subassembly may be configured to transmit the trigger signal after recognizing an expiration of the finite time period.

Figure 4:
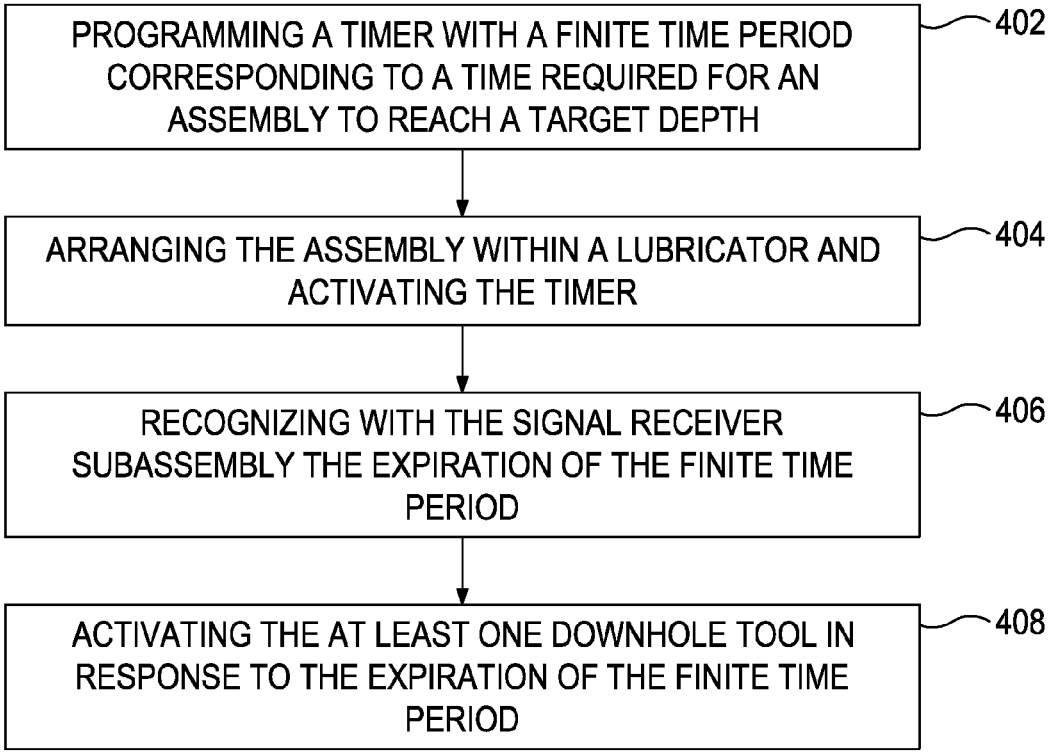
FIG. 4 illustrates flowchart schematic of a method of triggering a downhole tool, according to one or more embodiments

Referring now to FIG. 4, illustrated is an exemplary method 400 of triggering a downhole tool, according to one or more embodiments. The method 400 may include programming a timer with a finite time period corresponding to a time required for an assembly to reach a target depth within a wellbore, as at 402. The assembly may include a signal receiver subassembly and at least one downhole tool. The timer may be communicably coupled to or otherwise form an integral part of the signal receiver subassembly. The method 400 may also include arranging the assembly within a lubricator and activating the timer, as at 404. In some embodiments, the timer may be activated by communicating a signal, such as an acoustic or electronic signal, to the signal receiver subassembly. In some embodiments, the acoustic signal may be communicated by striking the lubricator or any other wellhead surface component, or generating vibrations at a predetermined frequency using a transducer or another type of vibration-inducing device coupled to one or more wellhead surface components.

The method 400 may further include recognizing with the signal receiver subassembly an expiration of the finite time period, as at 406. The at least one downhole tool may then be actuated in response to the expiration of the finite time period, as at 408. In some embodiments, the acoustic signal may be perceived with a transceiver communicably coupled to the signal receiver subassembly. In some embodiments, a signal indicative of whether the timer has been properly activated may be communicated with the transceiver to a listening device. Accordingly, an operator or user may be instantaneously made aware of whether the timer has been properly activated or not.

Figure 5:
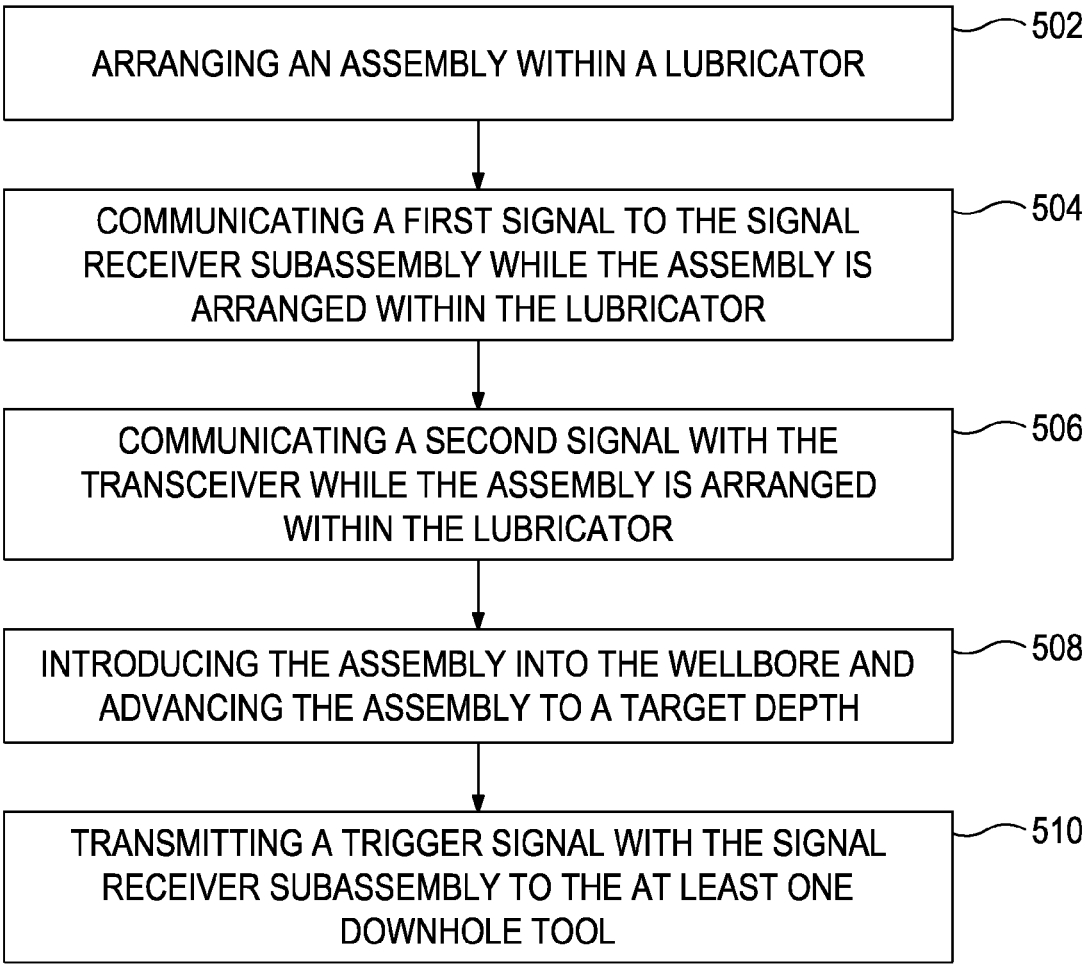
FIG. 5 illustrates a flowchart schematic of another method for servicing a wellbore, according to one or more embodiments disclosed.

Referring now to FIG. 5, illustrated is another exemplary method 500 of servicing a wellbore. The method 500 may include arranging an assembly within a lubricator, as at 502. The assembly may include at least one downhole tool and a signal receiver subassembly. In at least one embodiment, the at least one downhole tool is a sampling unit. The method 500 may further include communicating a first signal to the signal receiver subassembly while the assembly is arranged within the lubricator, as at 504. In some embodiments, the first signal is perceived with a transceiver that is communicably coupled to or otherwise forming an integral part of the signal receiver subassembly.

In some embodiments, arranging the assembly within the lubricator may be preceded by programming a timer with a finite time period corresponding to a time required for the assembly to reach a target depth. The timer may be activated in response to the first signal, the timer being communicably coupled to or otherwise forming an integral part of the signal receiver subassembly. In some embodiments, the first signal may be either an acoustic signal or an electronic signal. In at least one embodiment, an acoustic signal may be generated by striking a wellhead surface component.

The method 500 may further include communicating a second signal with the transceiver while the assembly is arranged within the lubricator, as at 506. In some embodiments, the second signal may be a confirmation that the first signal was received. In other embodiments, the second signal may also be indicative of whether the timer has been properly activated. In some embodiments, the second signal may be perceived with a listening device.

The method 500 may also include introducing the assembly into the wellbore and advancing the assembly until reaching the target depth, as at 508, and transmitting a trigger signal with the signal receiver subassembly to the at least one downhole tool, as at 510. In some embodiments, transmitting the trigger signal may be configured to actuate the at least one downhole tool. Moreover, transmitting the trigger signal may be preceded by recognizing with the signal receiver subassembly an expiration of the finite time period.

Figure 6:
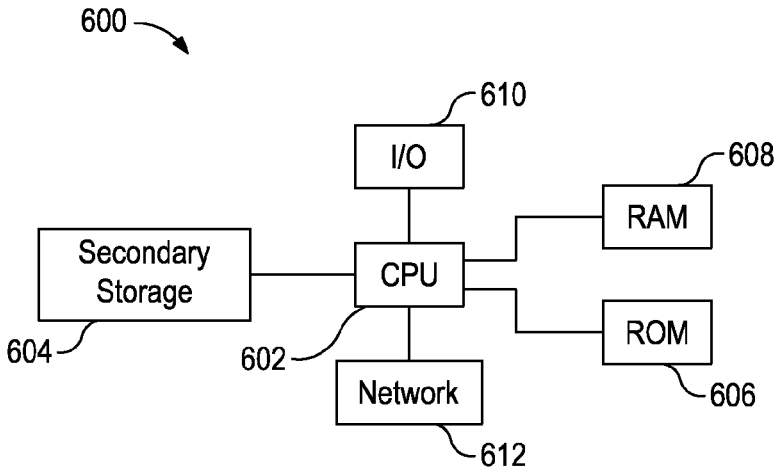
FIG. 6 illustrates a computer system suitable for implementing one or more of the embodiments of the disclosure.

FIG. 6 illustrates a computer system 600 suitable for implementing one or more of the exemplary embodiments disclosed herein. The computer system 600 includes a processor 602 (which may be referred to as a central processor unit or CPU) that is in communication with memory devices including secondary storage 604, read only memory (ROM) 606, random access memory (RAM) 608, input/output (I/O) devices 610, and network connectivity devices 612. The processor 602 may be implemented as one or more CPU chips.

It is understood that by programming and/or loading executable instructions onto the computer system 600, at least one of the CPU 602, the RAM 608, and the ROM 606 are changed, transforming the computer system 600 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically involve considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 604 may include one or more disk drives or tape drives and is used for non-volatile storage of data and as an over-flow data storage device if RAM 608 is not large enough to hold all working data. Secondary storage 604 may be used to store programs which are loaded into RAM 608 when such programs are selected for execution. The ROM 606 is used to store instructions and perhaps data which are read during program execution. ROM 606 is a non-volatile memory device which typically has a small memory capacity relative to the larger memory capacity of secondary storage 604. The RAM 608 is used to store volatile data and perhaps to store instructions. Access to both ROM 606 and RAM 608 is typically faster than to secondary storage 604.

Exemplary I/O devices 610 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 612 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), and/or worldwide interoperability for microwave access (WiMAX) radio transceiver cards, and other well-known network devices. These network connectivity devices 612 may enable the processor 602 to communicate with an Internet or one or more intranets. With such a network connection, it is contemplated that the processor 602 might receive information from the network, or might output information to the network in the course of performing the above-described method steps. Such information, which is often represented as a sequence of instructions to be executed using processor 602, may be received from and outputted to the network, for example, in the form of a computer data signal embodied in a carrier wave.

Such information, which may include data or instructions to be executed using processor 602, for example, may be received from and outputted to the network, for example, in the form of a computer data baseband signal or signal embodied in a carrier wave. The baseband signal or signal embodied in the carrier wave generated by the network connectivity devices 612 may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 602 executes instructions, codes, computer programs, scripts which it accesses from hard disk, floppy disk, optical disk (these various disk based systems may all be considered secondary storage 604), ROM 606, RAM 608, or the network connectivity devices 612. While only one processor 602 is shown, multiple processors may be present. Thus, while instructions may be discussed as executed by a processor, the instructions may be executed simultaneously, serially, or otherwise executed by one or multiple processors.

Those skilled in the art will readily recognize that the signal receiver subassembly 136 may be used in a variety of downhole applications. For example, the subassembly 136 may be advantageous in initiating the detonation of a perforation gun, opening or closing one or more valves or ports (i.e., in a sampling unit), opening or closing a sliding sleeve, causing a setting tool to set and/or release, starting the collection of data, stopping the collection of data, starting the transmission of data, stopping the transmission of data, activating and/or deactivating an electronic device, broaching a fluid bulkhead, breaking a rupture disk, combinations thereof, and several others. Moreover, the signal receiver subassembly may promote a variety of wellbore services including, but not limited to, retrieving wellbore fluid samples, hanging a liner, cementing, stimulation, hydraulic fracturing, acidizing, gravel packing, setting tools, setting lateral junctions, perforating casing and/or formations, collecting data, transmitting data, drilling, reaming, and other services.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of servicing a wellbore, comprising:

arranging an assembly within a lubricator coupled to a tree, the assembly including at least one downhole tool and a signal receiver subassembly;

communicating an acoustic signal to the signal receiver subassembly while the assembly is arranged within the lubricator;

perceiving the acoustic signal with a transceiver communicably coupled to the signal receiver subassembly and thereby activating a timer communicably coupled to the signal receiver subassembly while the assembly is arranged within the lubricator;

introducing the assembly into the wellbore and advancing the assembly until reaching a target depth; and transmitting a trigger signal with the signal receiver subassembly to the at least one downhole tool and thereby actuating the at least one downhole tool.

2. The method of claim 1, wherein communicating the acoustic signal comprises striking the lubricator or the tree.

3. The method of claim 1, wherein communicating the acoustic signal comprises generating vibrations using a transducer.

4. The method of claim 1, further comprising preprogramming the timer with a finite time period corresponding to a time required for the assembly to reach the target depth from the lubricator or tree.

5. The method of claim 4, wherein transmitting the trigger signal is preceded by recognizing with the signal receiver subassembly an expiration of the finite time period.

6. The method of claim 1, wherein the acoustic signal comprises an ordered sequence of vibrations and communicating the acoustic signal to the signal receiver subassembly comprises:

communicating the ordered sequence of vibrations within a distinct time interval;

recognizing the ordered sequence of vibrations within the distinct time interval with the signal receiver subassembly; and converting the ordered sequence of vibrations within the distinct time interval into an electrical signal that activates the timer.

7. The method of claim 1, wherein perceiving the acoustic signal with the transceiver communicably coupled to the signal receiver subassembly comprises:

processing the acoustic signal with the signal receiver subassembly; and performing frequency selective filtering with the signal receiver subassembly to determine if the acoustic signal matches a predetermined frequency or vibration required to activate the timer.

8. A method of triggering a downhole tool, comprising:

programming a timer with a finite time period corresponding to a time required for an assembly to reach a target depth within a wellbore, the assembly including a signal receiver subassembly and at least one downhole tool, wherein the timer is communicably coupled to the signal receiver subassembly;

arranging the assembly within a lubricator and communicating an acoustic signal to the signal receiver subassembly to activate the timer while the assembly is positioned in the lubricator;

recognizing with the signal receiver subassembly an expiration of the finite time period; and actuating the at least one downhole tool in response to the expiration of the finite time period.

9. The method of claim 8, further comprising perceiving the acoustic signal with a transceiver communicably coupled to the signal receiver subassembly.

10. An assembly, comprising:

at least one downhole tool positionable within a lubricator coupled to a tree;

a signal receiver subassembly communicably coupled to the at least one downhole tool;

a timer communicably coupled to the signal receiver subassembly, the timer being preprogrammed with a finite time period corresponding to a time required for the assembly to reach a target depth; and a transceiver communicably coupled to the signal receiver subassembly to receive an acoustic signal while positioned within the lubricator to activate the timer.

11. The assembly of claim 10, further comprising a transducer that produces vibrations to generate the acoustic signal.

12. The assembly of claim 10, wherein, upon expiration of the finite time period, the signal receiver subassembly transmits a trigger signal to the at least one downhole tool and thereby actuates the at least one downhole tool.

13. The assembly of claim 10, further comprising a listening device configured to receive a second signal from the transceiver while positioned within the lubricator, the second signal being indicative of whether the timer has been properly activated.

14. A method of servicing a wellbore, comprising:

arranging an assembly within a lubricator, the assembly including at least one downhole tool and a signal receiver subassembly;

communicating an acoustic signal to the signal receiver subassembly while the assembly is arranged within the lubricator; perceiving the acoustic signal with a transceiver communicably coupled to the signal receiver subassembly;

perceiving the acoustic signal with a transceiver communicably coupled to the signal receiver subassembly and thereby activating a timer communicably coupled to the signal receiver subassembly while the assembly is arranged within the lubricator;

communicating a confirmation signal with the transceiver while the assembly is arranged within the lubricator, the confirmation signal confirming that the acoustic signal was received;

introducing the assembly into the wellbore and advancing the assembly until reaching a target depth; and transmitting a trigger signal with the signal receiver subassembly to the at least one downhole tool and thereby actuating the at least one downhole tool.

15. The method of claim 14, wherein arranging the assembly within the lubricator is preceded by programming the timer with a finite time period corresponding to a time required for the assembly to reach the target depth, the timer being communicably coupled to the signal receiver subassembly.

16. The method of claim 15, wherein transmitting the trigger signal is preceded by recognizing with the signal receiver subassembly an expiration of the finite time period.

17. The method of claim 14, further comprising perceiving the confirmation signal with a listening device, the confirmation signal being indicative of whether the timer has been properly activated.

18. The method of claim 14, wherein the acoustic signal comprises an ordered sequence of vibrations and communicating the acoustic signal to the signal receiver subassembly comprises:

communicating the ordered sequence of vibrations within a distinct time interval;

recognizing the ordered sequence of vibrations within the distinct time interval with the signal receiver subassembly; and converting the ordered sequence of vibrations within the distinct time interval into an electrical signal that activates the timer.

19. The method of claim 14, wherein perceiving the acoustic signal with the transceiver communicably coupled to the signal receiver subassembly comprises:

processing the acoustic signal with the signal receiver subassembly; and performing frequency selective filtering with the signal receiver subassembly to determine if the acoustic signal matches a predetermined frequency or vibration required to activate the timer.

* * * * *